US010309234B2

(12) United States Patent
Hoell et al.

(10) Patent No.: US 10,309,234 B2
(45) Date of Patent: Jun. 4, 2019

(54) WHEEL DISK ASSEMBLY

(71) Applicant: Siemens Aktiengesellschaft, Munich (DE)

(72) Inventors: Harald Hoell, Wächtersbach (DE); Kevin Kampka, Mülheim a.d. Ruhr (DE); Karsten Kolk, Mülheim a.d. Ruhr (DE); Marc Lange, Köln (DE); Peter Schröder, Essen (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 320 days.

(21) Appl. No.: 15/324,857

(22) PCT Filed: Jul. 9, 2015

(86) PCT No.: PCT/EP2015/065664
§ 371 (c)(1),
(2) Date: Jan. 9, 2017

(87) PCT Pub. No.: WO2016/008781
PCT Pub. Date: Jan. 21, 2016

(65) Prior Publication Data

US 2017/0204732 A1 Jul. 20, 2017

(30) Foreign Application Priority Data

Jul. 17, 2014 (EP) ..... 14177468

(51) Int. Cl.
*F01D 5/30* (2006.01)

(52) U.S. Cl.
CPC ..... *F01D 5/3015* (2013.01); *F05D 2240/55* (2013.01)

(58) Field of Classification Search
CPC .. F01D 5/3015; F01D 5/3007; F05D 2240/00; F05D 2240/55
(Continued)

(56) References Cited

U.S. PATENT DOCUMENTS 2,998,959 A * 9/1961 Moss ..... F01D 5/3015 416/193 A
3,572,966 A 3/1971 Borden et al.
(Continued)

FOREIGN PATENT DOCUMENTS

EP 1916389 A1 4/2008
EP 1944472 A1 7/2008
(Continued)

OTHER PUBLICATIONS

JP Office Action dated Mar. 19, 2018, for JP patent application No. 2017502632.
(Continued)

*Primary Examiner* — Hieu T Vo
*Assistant Examiner* — Arnold Castro
(74) *Attorney, Agent, or Firm* — Beusse Wolter Sanks & Maire

(57) ABSTRACT

Wheel disc arrangement has a wheel disc, a plurality of blade devices fastened along the outer circumference, and a plurality of sealing plates held in two radially spaced-apart annular grooves. The first annular groove is bounded axially outwards by an annular projection. The second annular groove is defined by a plurality of adjacently arranged annular groove segments in the individual blade devices. The first annular groove is of undercut design and has at least two axially opposite and protruding holding projections with a respective bearing surface. The sealing plates have, in the inside diameter, two supporting projections corresponding to the holding projections, axially opposite
(Continued)

and face away from one another, with a supporting surface. The arrangement is configured such that the supporting surfaces of the sealing plates are supported against the bearing surfaces of the holding projections under the effect of a centrifugal force.

10 Claims, 3 Drawing Sheets

(58) Field of Classification Search
USPC ..... 416/220 R
See application file for complete search history.

(56) References Cited

U.S. PATENT DOCUMENTS

| | | | | |
|---|---|---|---|---|
| 4,648,799 | A | 3/1987 | Brown et al. | |
| 2008/0008593 | A1 | 1/2008 | Zagar et al. | |
| 2008/0181767 | A1 | 7/2008 | Brillert et al. | |
| 2010/0047073 | A1 | 2/2010 | Bluck et al. | |
| 2016/0265378 | A1* | 9/2016 | Dungs | F01D 5/3015 |
| 2017/0037736 | A1* | 2/2017 | Dungs | F01D 5/3015 |
| 2017/0191371 | A1* | 7/2017 | Dungs | F01D 5/3015 |
| 2017/0211397 | A1* | 7/2017 | Hoell | F01D 5/3015 |
| 2017/0241276 | A1* | 8/2017 | Kampka | F01D 5/3015 |
| 2017/0241284 | A1* | 8/2017 | Hoell | F01D 5/3015 |
| 2018/0023401 | A1* | 1/2018 | Hoell | F01D 5/3015 416/220 R |

FOREIGN PATENT DOCUMENTS

| | | | |
|---|---|---|---|
| JP | S4825686 | B1 | 7/1973 |
| JP | S5844202 | A | 3/1983 |

OTHER PUBLICATIONS

EP Search Report dated Oct. 30, 2014, for EP application No. 14177468.7.

International Search Report dated Oct. 2, 2015, for PCT application No. PCT/EP2015/065664.

* cited by examiner

WHEEL DISK ASSEMBLY

CROSS REFERENCE TO RELATED APPLICATIONS

This application is the US National Stage of International Application No. PCT/EP2015/065664 filed Jul. 9, 2015, and claims the benefit thereof. The International Application claims the benefit of European Application No. EP14177468 filed Jul. 17, 2014. All of the applications are incorporated by reference herein in their entirety.

FIELD OF INVENTION

The present invention relates to a wheel disk assembly, having a wheel disk, a plurality of blade devices, which are fastened along the outer circumference of the wheel disk, a plurality of sealing plates, which are retained in two annular grooves spaced apart from each other radially, wherein the first annular groove is provided in the wheel disk and is bounded axially outward by an annular projection, and wherein the second annular groove is defined by a multiplicity of adjacently arranged annular groove segments, which are each provided in the individual blade devices.

BACKGROUND OF INVENTION

Wheel disk assemblies of the type stated at the outset are known in many different embodiments in the prior art. During assembly, the blade devices are inserted into grooves in the wheel disk, wherein the sealing plates are successively also inserted into the two annular grooves. To enable the last two blade devices to be installed, it is necessary that all the sealing plates should already have been mounted and moved beyond the areas of overlap thereof into the annular grooves to such an extent that the blade devices can be installed in the associated grooves in the wheel disk. The sealing plates are then pushed back again in the circumferential direction into the intended position thereof and are secured there in a suitable manner against displacement.

One disadvantage of the known wheel disk assemblies is that the sealing plates are pressed against the blade devices under the action of the prevailing centrifugal force during the operation of the wheel disk assembly as intended, with the result that the entire intrinsic weight of the sealing plates acts on the blade devices. This leads to a high stress on the joints between the wheel disk and the blade devices, for which reason these have to be of very massive construction and this is associated with high costs.

As an alternative to this, there is a proposal known from EP 1 944 472 A1, for example, to support the sealing plates radially on the wheel disk, thus ensuring that the centrifugal forces thereof are taken by the wheel disk. For this purpose, a projection is provided on each sealing plate, said projection engaging behind a corresponding projection on the wheel disk. However, the unilateral force transmission into the wheel disk is disadvantageous.

SUMMARY OF INVENTION

Starting from this prior art, it is an object of the present invention to provide a wheel disk assembly of the type stated at the outset involving alternative, inexpensive construction.

To achieve this object, the present invention provides a wheel disk assembly of the type stated at the outset which is characterized in that the first annular groove is of undercut design and, when viewed in cross section, has at least one axially protruding retaining projection, which is provided with a contact surface, and that the sealing plates, when viewed in cross section, each have at least one axially protruding support projection in the region of the inside diameter, said support projection being designed to correspond to the at least one retaining projection and being provided with a support surface, wherein the contact surface of the at least one retaining projection, the support surface of the at least one support projection and the height of the sealing plates are designed in such a way that the support surfaces of the sealing plates are supported against the contact surface of the at least one retaining projection under the action of a centrifugal force during the operation of the wheel disk assembly as intended. By virtue of this embodiment, the intrinsic weight of the sealing plates is supported by the at least one retaining projection of the wheel disk under the action of a centrifugal force during the operation of the wheel disk assembly as intended. This relieves the load on the joints between the wheel disk and the blade devices since the centrifugal force imposed is "decoupled" from the sealing plates. This has the effect that the wheel disk can be made thinner in said regions of joints with the blade devices. The same also applies to the platforms of the blade devices, by means of which the blade devices are retained on the wheel disk, since these do not have to support the weight of the sealing plates. Overall, a very low-cost construction is obtained in this way.

Moreover, the first annular groove, when viewed in cross section, has two retaining projections, which are situated axially opposite each other, are directed toward each other and are each provided with a contact surface, and the sealing plates, when viewed in cross section, comprise two support projections in the region of the inside diameter, which are designed to correspond to the retaining projections, are situated axially opposite each other and are directed away from each other, each of said projections being provided with a support surface, wherein the contact surfaces and the support surfaces are designed in such a way that the support surfaces of the sealing plates are supported against the contact surfaces of the retaining projections under the action of a centrifugal force during the operation of the wheel disk assembly as intended. The provision of an additional retaining projection and of an additional support projection ensures that the weight of the sealing plates is distributed more uniformly during operation as intended, thereby achieving better stability and introduction of force into the wheel disk.

The contact surfaces of the at least one retaining projection and the contact surfaces of the sealing plates each advantageously extend both transversely to the radial direction and transversely to the axial direction. In other words, the contact surfaces and the support surfaces each slope.

The lateral surfaces of the sealing plates advantageously extend at least in part transversely to the axial direction and are designed in such a way that the sealing plates overlap in the region of the lateral surfaces thereof in respect of the axial direction in the intended state. In this way, a sealing effect is achieved in the axial direction between the lateral surfaces of adjacently arranged sealing plates.

The lateral surfaces of the sealing plates are advantageously of stepped design, with the result that the sealing plates can be moved by a certain amount while retaining an overlap with each other in the circumferential direction. The stepping should be chosen in such a way that the sealing plates can be pushed together in such a way, in a state in which all the sealing plates of a wheel disk assembly have been mounted, that it is possible to set a spacing greater than the width of a single sealing plate between two adjacently arranged sealing plates. Such an embodiment can be advantageous, depending on the way in which the sealing plates are mounted, as will be clear from the embodiment described below with reference to the figures.

According to one embodiment of the present invention, at least one aperture extending axially through the annular projection is provided, the minimum width of which aperture in the circumferential direction is greater than the width of the sealing plates in the region of the inside diameter, with the result that a sealing plate can be inserted axially through the recess between the annular grooves and can be moved in the circumferential direction while being guided by the latter. By virtue of a recess of this kind, the sealing plates can be inserted into the associated annular grooves in a simple manner, even if all the blade devices have already been mounted on the wheel disk, thereby making assembly very flexible. Moreover, the individual sealing plates can be removed again without much effort through the recess in the case of a service.

Advantageously, two recesses are provided, which are formed opposite each other in the wheel disk. By offsetting the recesses circumferentially, in particular by 180 degrees, mounting and removal of the sealing plates is made easier, on the one hand. On the other hand, the provision of a second recess arranged opposite the first recess compensates for any potential unbalance.

At least one closure piece is advantageously provided, which can be detachably fastened to the wheel disk to close the at least one recess, wherein the closure piece has a receiving surface to receive at least one sealing plate.

The at least one closure piece advantageously has, on opposite sides, radially outward-protruding closure-piece projections, which engage in correspondingly designed pockets of the recess in the intended state. In this way, the closure piece can be secured on the wheel disk in the circumferential direction.

In the region of its receiving surface, the at least one closure piece advantageously has a web, which extends in the radial direction and engages in correspondingly designed sealing plate grooves formed on the inside diameter of at least two sealing plates in the intended state. In this way, it is possible to ensure that the closure piece is secured by the sealing plate or plates positioned adjacently to said closure piece in the state of the closure piece in which it is arranged as intended.

According to one embodiment of the present invention, edges of the annular groove and/or of the support projections and/or of the closure piece are provided with radii in order to avoid excessive stress concentrations.

BRIEF DESCRIPTION OF THE DRAWINGS

Further features and advantages of the present invention will become clear from the following description of a wheel disk assembly according to one embodiment of the present invention, with reference to the appended drawing, in which.

DETAILED DESCRIPTION OF INVENTION

Figure 1:
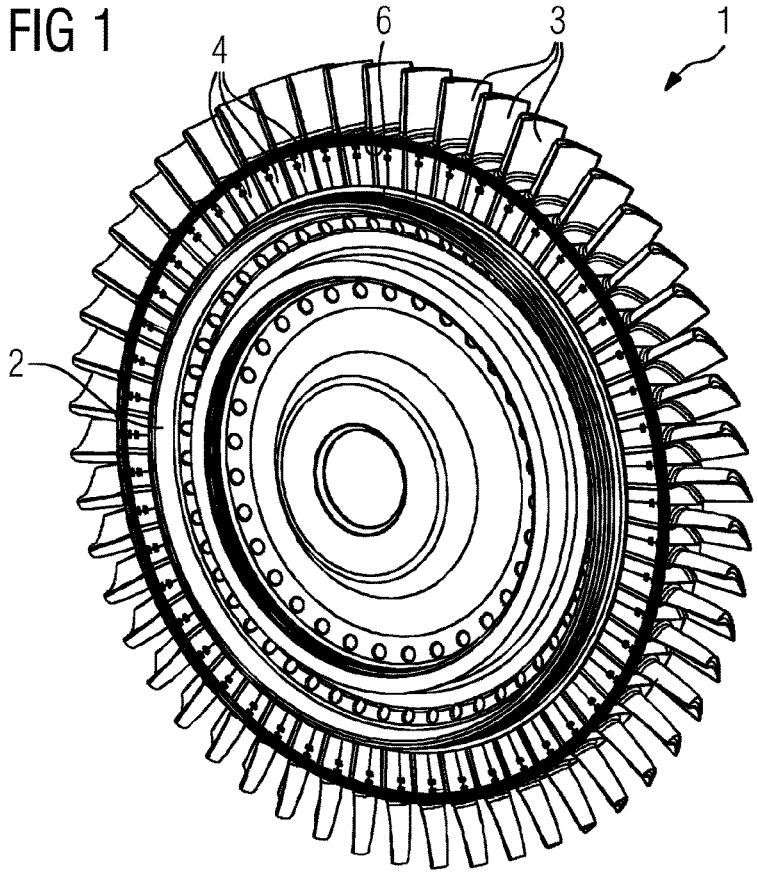
FIG. 1 is a perspective view of a wheel disk assembly according to one embodiment of the present invention in the fully assembled state.
Figure 2:
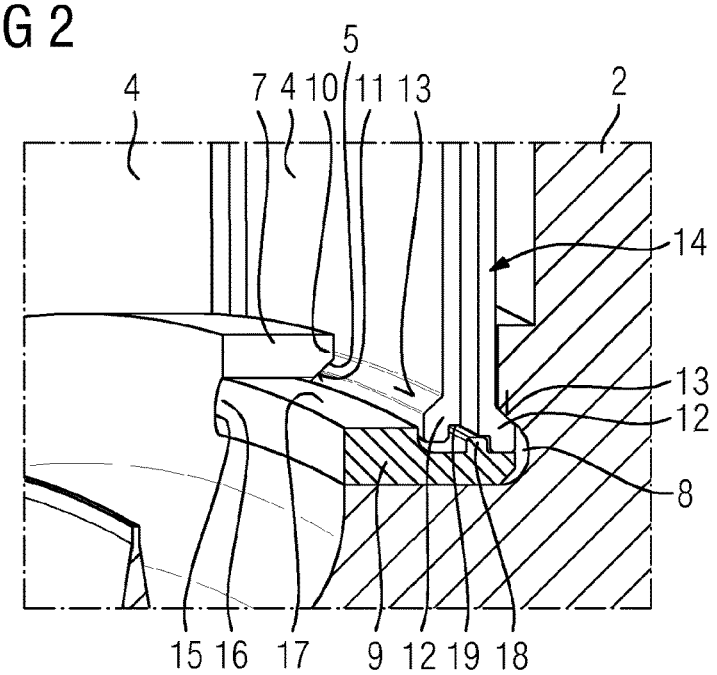
FIG. 2 is an enlarged sectional view of the detail indicated by reference sign II in FIG. 1.
Figure 3:
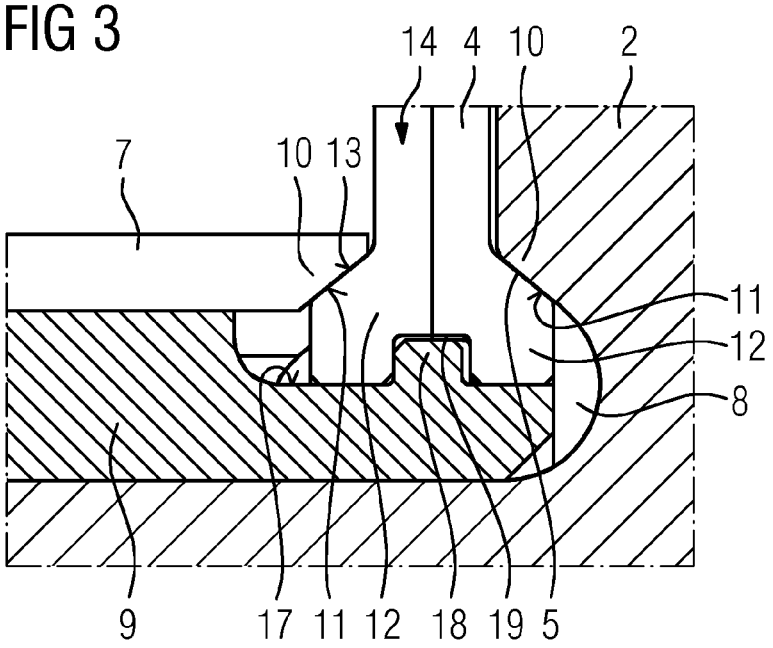
FIG. 3 is an enlarged side view of the assembly illustrated in FIG. 2.
Figure 4:
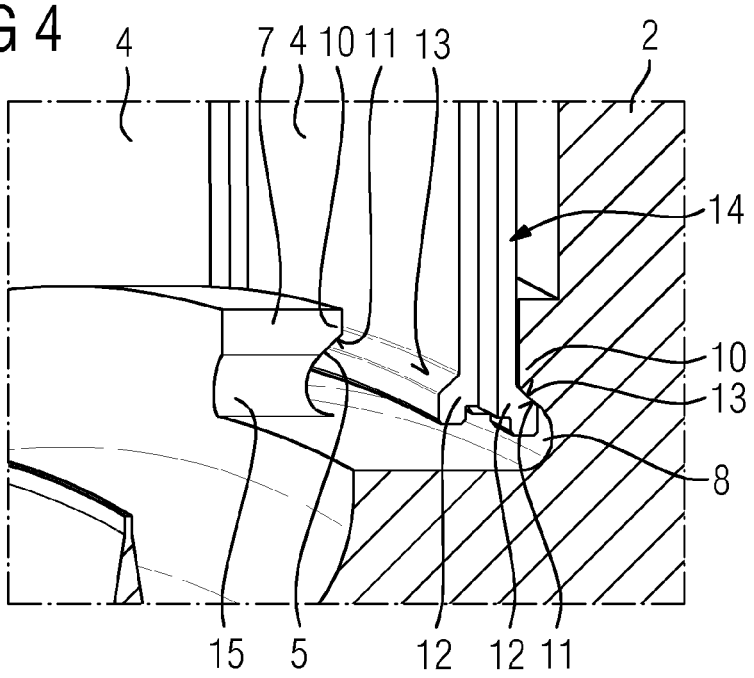
FIG. 4 is an enlarged view of the assembly illustrated in FIG. 2, wherein a closure piece has been omitted for illustration purposes.

FIGS. 1 to 4 show a wheel disk assembly 1 according to one embodiment of the present invention, or components thereof. The wheel disk assembly 1 comprises a wheel disk 2, a plurality of blade devices 3, which are fastened along the outer circumference of the wheel disk 2, and a plurality of sealing plates 4, which are retained between the wheel disk 2 and the blade devices 3 in two annular grooves 5 and 6 spaced apart from each other radially. In this assembly, the first annular groove 5 is provided in the wheel disk 2 and is bounded axially outward by an annular projection 7. The second annular groove 6 is defined by a multiplicity of adjacently arranged annular groove segments, which are each formed in the blade devices 3. To facilitate the installation of the sealing plates 4, the wheel disk 2 comprises at least one recess 8 extending axially through the annular projection 7, the minimum width of which recess in the circumferential direction is greater than the width of the sealing plates 4 at the inside diameter. Accordingly, the sealing plates 4 can be inserted axially through the recess 8 between the annular grooves 5 and 6 and can be moved in the circumferential direction while being guided by the latter. For the closure of the recess 8, the wheel disk assembly 1 furthermore comprises a closure piece 9, which can be detachably fastened to the wheel disk 2.

When viewed in cross section, the annular groove 5 provided in the wheel disk 2 has two retaining projections 10, which are situated axially opposite each other, are directed toward each other and are each provided with a contact surface 11. The sealing plates 4, when viewed in cross section, comprise two support projections 12 in the region of the inside diameter thereof, which are designed to correspond to the retaining projections 10, are situated axially opposite each other and are directed away from each other, each of said support projections being provided with a support surface 13. The retaining projections 10 and the support projections 12 each extend both transversely to the radial direction R and transversely to the axial direction A and, in the present case, are arranged on the angle bisector, although other slopes are also possible. The contact surfaces 11 of the retaining projections 10, the support surfaces 13 of the support projections 12 and the height of the sealing plates 4 are designed or selected in such a way that the support surfaces 13 of the sealing plates 4 are supported against the contact surfaces 11 of the retaining projections 10 under the action of a centrifugal force during the operation of the wheel disk assembly 1 as intended.

The lateral surfaces 14 of the sealing plates 4 extend at least in part transversely to the axial direction A and are designed in such a way that the sealing plates 4 overlap in the region of the lateral surfaces 14 thereof in respect of the axial direction A in the intended state. In the present case, the lateral surfaces 14 of the sealing plates 4 are of stepped design, with the result that adjacently arranged and mutually overlapping sealing plates 4 can be moved in the radial direction while retaining the overlap. The extent of the overlap is chosen so that, in a state in which all the sealing plates 4 have been mounted on the wheel disk assembly 1, as shown in FIG. 1, the sealing plates 4 can be pushed into one another in such a way that a spacing greater than the maximum width of the sealing plates 4 can be set between two adjacently arranged sealing plates 4.

The recess 8 comprises pockets 15 arranged on both sides, which extend axially through the entire annular projection 7 and form undercuts in the radial direction. The closure piece 9 has radially outward-protruding closure-piece projections 16, which are designed to correspond to the pockets 15 and engage in the pockets 15 in the state of the closure piece 9 in which it is arranged as intended, thereby ensuring that the closure piece 9 is secured in the radial direction. The closure piece 9 furthermore comprises a receiving surface 17, which serves to receive at least one sealing plate 4. In the region of the receiving surface 17, the closure piece 9 has a web 18, which extends in the radial direction and engages in correspondingly designed sealing plate grooves 19 in the intended state, said grooves being provided on the inside diameter of the sealing plates 4.

To assemble the wheel disk assembly 1 illustrated in FIG. 1, all of the blade devices 3 are fastened to the wheel disk 2 in a known manner in a first step. After this, the individual sealing plates 4 are introduced axially, one after the other, into the annular grooves 5 and 6 through the recess 8 and then moved in the circumferential direction and arranged one against the other. By virtue of the stepped embodiment of the lateral surfaces 14 of the sealing plates 4, it is possible here for the region of the recess 8 to remain free from a sealing plate after the mounting of all the sealing plates 4. In a further step, the closure piece 9 is then inserted axially into the recess 8, wherein the closure-piece projections 16 enter into engagement with the pockets 15 of the annular projection 7, thereby ensuring that the closure piece 9 is secured radially. In a subsequent step, the sealing plates 4 are moved in the circumferential direction into the intended position thereof. During this process, the sealing plate grooves 19 of two adjacent sealing plates 4 are each moved partially into engagement with the web 18 protruding from the receiving surface 17 of the closure piece 9.

In a further step, the sealing plates 4 are fixed in the intended circumferential position thereof by suitable means. Thus, for example, fixing can be accomplished using bolts (not shown specifically) which extend through slotted holes provided in the sealing plates 4 and extending in the radial direction and are fixed on the wheel disk 2. The slotted holes serve to enable movement of the sealing plates 4 in the radial direction during the operation of the wheel disk assembly 1 as intended. Of course, it is also possible, as an alternative, to use other suitable fastening means to fix the sealing plates 4 in the intended circumferential position thereof. In the now fully assembled state of the wheel disk assembly 1, the closure piece 9 is also fixed in the axial direction by virtue of the engagement between the sealing plate grooves 19 and the web 18.

Figure 5:
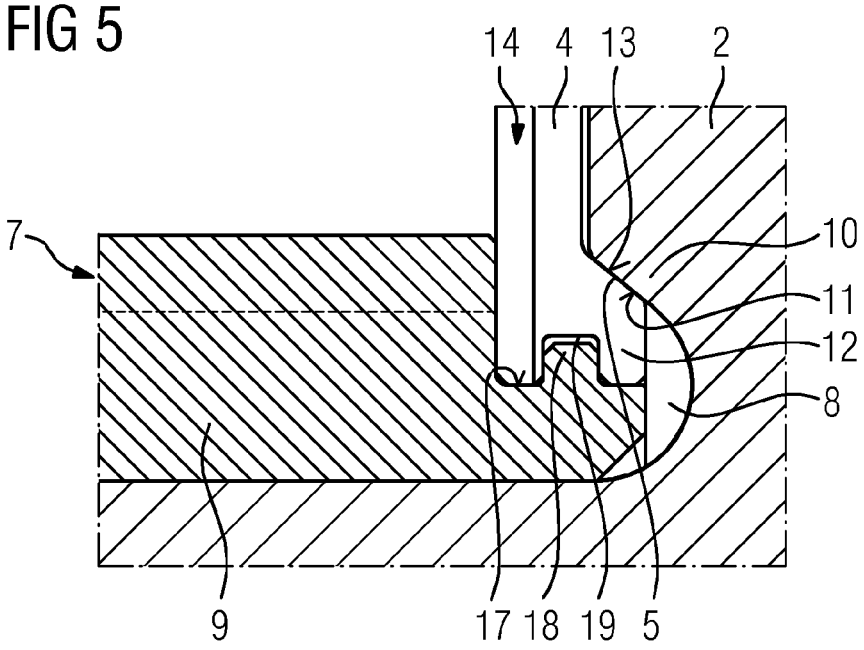
FIG. 5 is an enlarged side view of an alternative embodiment according to the invention of the assembly illustrated in FIGS. 2 to 4.

One significant advantage of the wheel disk assembly 1 is that the sealing plates can be fitted and removed easily and without problems, even when the blade devices 3 have already been fixed or are still fixed on the wheel disk 2. Furthermore, the contact surface 11 of the retaining projections 10, the support surfaces 13 of the support projections 12 and the height of the sealing plates 4 are designed in such a way that the support surfaces 13 of the sealing plates 4 are supported against the contact surface 11 of the retaining projections 10 under the action of a centrifugal force during the operation of the wheel disk assembly 1 as intended. Thus, the intrinsic weight of the sealing plates 4 is supported by the wheel disk 2, this having the effect that the regions of the joints between the wheel disk 2 and the blade devices 3 do not have to be as robust and hence can be produced at lower cost. By virtue of the symmetrical design of the retaining projections 10 and of the support projections 12, very uniform introduction of force into the wheel disk 2 is furthermore achieved. However, it should be clear that it is sufficient in principle to provide a single retaining projection 10 and a single support projection 12, as illustrated in FIG. 5, in which identical or similar components are provided with the same reference signs as in FIGS. 1 to 4.

Although the invention has been described and illustrated in detail by way of the preferred exemplary embodiment, the invention is not restricted by the disclosed examples and other variations can be derived herefrom by a person skilled in the art without departing from the scope of protection of the invention.

The invention claimed is:

1. A wheel disk assembly, comprising:

a wheel disk, a plurality of blade devices, which are fastened along the outer circumference of the wheel disk, and a plurality of sealing plates, which are retained in two annular grooves comprising a first annular groove and a second annular groove spaced apart from each other radially, wherein the first annular groove is provided in the wheel disk and is bounded axially outward by an annular projection, and wherein the second annular groove is defined by a multiplicity of adjacently arranged annular groove segments, which are each provided in the individual blade devices, wherein the first annular groove is of undercut design and, when viewed in cross section, has at least one axially protruding retaining projection, which is provided with a contact surface, and that the sealing plates, when viewed in cross section, each have at least one axially protruding support projection in the region of the inside diameter, said support projection being designed to correspond to the at least one retaining projection and being provided with a support surface, wherein the contact surface of the at least one retaining projection, the support surface of the at least one support projection and the height of the sealing plates are designed in such a way that the support surfaces of the sealing plates are supported against the contact surface of the at least one retaining projection under the action of a centrifugal force during the operation of the wheel disk assembly as intended, wherein the first annular groove, when viewed in cross section, has two retaining projections, which are situated axially opposite each other, are directed toward each other and are each provided with a contact surface, and in that the sealing plates, when viewed in cross section, comprise two support projections in the region of the inside diameter, which are designed to correspond to the retaining projections, are situated axially opposite each other and are directed away from each other, each of said projections being provided with a support surface, wherein the contact surfaces and the support surfaces are designed such that the support surfaces of the sealing plates are supported against the contact surfaces of the retaining projections under the action of a centrifugal force during the operation of the wheel disk assembly as intended.

2. The wheel disk assembly as claimed in claim 1, wherein the contact surface of the at least one retaining projection and the contact surfaces of the sealing plates each extend both transversely to the radial direction and transversely to the axial direction.

3. The wheel disk assembly as claimed in claim 1, wherein the lateral surfaces of the sealing plates extend at least in part transversely to the axial direction and are designed such that the sealing plates overlap in the region of the lateral surfaces thereof in respect of the axial direction in the intended state.

4. The wheel disk assembly as claimed in claim 3, wherein the lateral surfaces of the sealing plates are of stepped design.

5. The wheel disk assembly as claimed in claim 1, further comprising:

at least one recess extending axially through the annular projection, the minimum width of which recess in the circumferential direction is greater than the width of the sealing plates in the region of the inside diameter, with the result that a sealing plate is insertable axially through the recess between the annular grooves and is moveable in the circumferential direction while being guided by the latter.

6. The wheel disk assembly as claimed in claim 5, further comprising:

two recesses, which are formed opposite each other in the wheel disk.

7. The wheel disk assembly as claimed in claim 5, further comprising:

at least one closure piece, which is detachably fastenable to the wheel disk to close the at least one recess wherein the closure piece has a receiving surface for receiving at least one sealing plate.

8. The wheel disk assembly as claimed in claim 7, wherein the at least one closure piece has, on opposite sides, radially outward-protruding closure-piece projections, which engage in correspondingly designed pockets of the recess in the intended state.

9. The wheel disk assembly as claimed in claim 7, wherein in the region of its receiving surface, the at least one closure piece has a web, which extends in the radial direction and engages in correspondingly designed sealing plate grooves formed on the inside diameter of at least two sealing plates in the intended state.

10. The wheel disk assembly as claimed in claim 1, wherein edges of the annular groove and/or of the support projections and/or of the closure piece are provided with radii.

* * * * *